US008219506B2

(12) United States Patent
Eberhart et al.

(10) Patent No.: US 8,219,506 B2
(45) Date of Patent: Jul. 10, 2012

(54) METHOD AND APPARATUS FOR EVOLVING OVERLAYS TO OPERATE AN EXTENDED ANALOG COMPUTER AS A CLASSIFIER OR A CONTROLLER

(75) Inventors: Russell C. Eberhart, Indianapolis, IN (US); Jonathan W. Mills, Bloomington, IN (US); Bryce Himebaugh, Bloomington, IN (US); Xiaohui Hu, Indianapolis, IN (US)

(73) Assignee: Indiana University Research and Technology Corp., Indianapolis, IN (US)

( * ) Notice: Subject to any disclaimer, the term of this patent is extended or adjusted under 35 U.S.C. 154(b) by 533 days.

(21) Appl. No.: 12/514,897

(22) PCT Filed: Nov. 13, 2007

(86) PCT No.: PCT/US2007/023733

§ 371 (c)(1),
(2), (4) Date: May 14, 2009

(87) PCT Pub. No.: WO2008/060502

PCT Pub. Date: May 22, 2008

(65) Prior Publication Data

US 2010/0030711 A1 Feb. 4, 2010

Related U.S. Application Data

(60) Provisional application No. 60/858,814, filed on Nov. 14, 2006.

(51) Int. Cl.
*G06G 7/00* (2006.01)

(52) U.S. Cl. ..... 706/3

(58) Field of Classification Search ..... None
See application file for complete search history.

(56) References Cited

U.S. PATENT DOCUMENTS

| | | | | |
|---|---|---|---|---|
| 3,924,109 | A * | 12/1975 | Jhu et al. | 714/736 |
| 5,770,966 | A | 6/1998 | Mills | |
| 5,796,919 | A | 8/1998 | Kubica | |
| 5,917,338 | A | 6/1999 | Mills | |
| 2004/0065741 | A1 | 4/2004 | Reddersen et al. | |
| 2005/0172044 | A1 | 8/2005 | Chien et al. | |
| 2006/0212209 | A1 | 9/2006 | Cesario et al. | |

OTHER PUBLICATIONS

"Parallel particle swarm optimization and finite-difference time-domain (PSO/FDTD) algorithm for multiband and wide-band patch antenna designs", Jin et al, Antennas and Propagation, 2005.*
International Search Report and Written Opinion, International Searching Authority, U.S. Patent & Trademark Office, Alexandria, Virginia, May 14, 2008.

* cited by examiner

*Primary Examiner* — Omar Fernandez Rivas
*Assistant Examiner* — Luis Sitiriche
(74) *Attorney, Agent, or Firm* — Maginot, Moore & Beck, LLP

(57) ABSTRACT

A method is used to configure an extended analog computer for use as an application controller. The method includes selecting input pins from among a plurality of pins in a continuous sheet processor, selecting an arrangement of intermediate and output pins from among the remaining pins in the plurality of pins in the continuous sheet processor, applying a pattern data set to the input pins, using an evolutionary algorithm, coupling current sources and sinks to the intermediate and output pins, measuring an error between an output and its expected value, and continuing to select intermediate and output pin arrangements, apply pattern data sets, and measure errors until a configuration threshold is met.

18 Claims, 3 Drawing Sheets

METHOD AND APPARATUS FOR EVOLVING OVERLAYS TO OPERATE AN EXTENDED ANALOG COMPUTER AS A CLASSIFIER OR A CONTROLLER

This application is filed under 35 U.S.C. 371 claiming priority from international application PCT/US2007/023733, which was filed on Nov. 13, 2007, and which claims priority from U.S. provisional application Ser. No. 60/858,814, which was filed on Nov. 14, 2006.

TECHNICAL FIELD

The present invention relates generally to analog computing and to hybrid digital/analog computing, and more particularly, to generating overlays for these types of computers.

GLOSSARY

The term evolutionary computation is used herein to refer to machine learning optimization and classification paradigms that are inspired by evolutionary mechanisms such as biological genetics and natural selection. The evolutionary computation field includes genetic algorithms, particle swarm optimization, evolutionary programming, genetic programming, and evolution strategies.

A swarm is used herein to refer to a population of interacting elements that collaboratively search through a problem space in order to optimize some global objective. Problems involving multiple objectives and/or multiple constraints are also optimized. Interactions between relatively local (topologically) swarm elements are often emphasized. Moreover, a swarm tends to have a general stochastic (or near-chaotic) characteristic that causes swarm elements to move toward a center of mass in the population located on critical dimensions, thus resulting in convergence on an optimum (or multiple optima) for the global objective of the swarm.

A particle swarm, as used herein, is similar to a genetic algorithm (GA) in that the system is initialized with a population of randomized positions in hyperspace that represent potential solutions to an optimization problem. However, each particle of a particle swarm, unlike a GA, is also assigned a randomized velocity. The particles (i.e., potential solutions) are then "flown" through hyperspace based upon their respective velocities in search of an optimum solution (or optimum solutions, in case of multiple optima) to a global objective.

BACKGROUND

Digital microcontrollers are in widespread use. Approximately 4-5 billion were manufactured in 2005. These microcontrollers, such as PICs and 8051s are self-contained computers that are generally programmed to do one task. Personal computers (PCs) and almost all other computers are digital machines. They do not perform tasks that can be performed by analog computers as quickly, or by using simple analog computing circuitry. In some instances, they are substantially more complex and costly than needed if analog capability were utilized.

As is the case with digital microcontrollers, an analog microcontroller would generally be configured (not really programmed as digital microcontrollers are) to do one task. However, the analog microcontroller can be implemented with no RAM, no ROM, no clock, and no program as used in digital microcontrollers. Because of its simplicity, it is less expensive. Because of its implementation using only analog components including a continuous sheet processor, It is also much faster. (Some digital logic on the input and/or the output may be needed in certain applications to interface the analog microcontroller to digital devices/systems.) The sheet processor with multiple pins can be implemented with a wide variety of materials and configurations, including polymer sheets, conductive foam, and silicon.

These analog microprocessors can also be used in combination with digital processors to realize hybrid machines that have capabilities not currently available, or that can provide currently-available capabilities significantly more rapidly and less expensively. The configuration of these hybrid machines, including which tasks are done by digital and which by analog means, and how those tasks are accomplished in an optimal manner, need to be done using a method and apparatus that are flexible, rapid, inexpensive, and able to respond to highly complex and changing environments.

A need therefore exists for a method and apparatus which evolve the configurations for analog microcontrollers and for digital/analog hybrid computers that utilize continuous computing methodology.

SUMMARY

A method is described below that may be used to configure an extended analog computer for use as an application controller. The method includes selecting input pins from among a plurality of pins in a continuous sheet processor, selecting an arrangement of intermediate and output pins from among the remaining pins in the plurality of pins in the continuous sheet processor, applying a pattern data set to the input pins, using an evolutionary algorithm, coupling current sources and sinks to the intermediate and output pins, measuring an error between an output and its expected value, and continuing to select intermediate and output pin arrangements, apply pattern data sets, and measure errors until a configuration threshold is met.

DETAILED DESCRIPTION OF EXEMPLARY EMBODIMENTS AND PROCESSES

Figure 1:
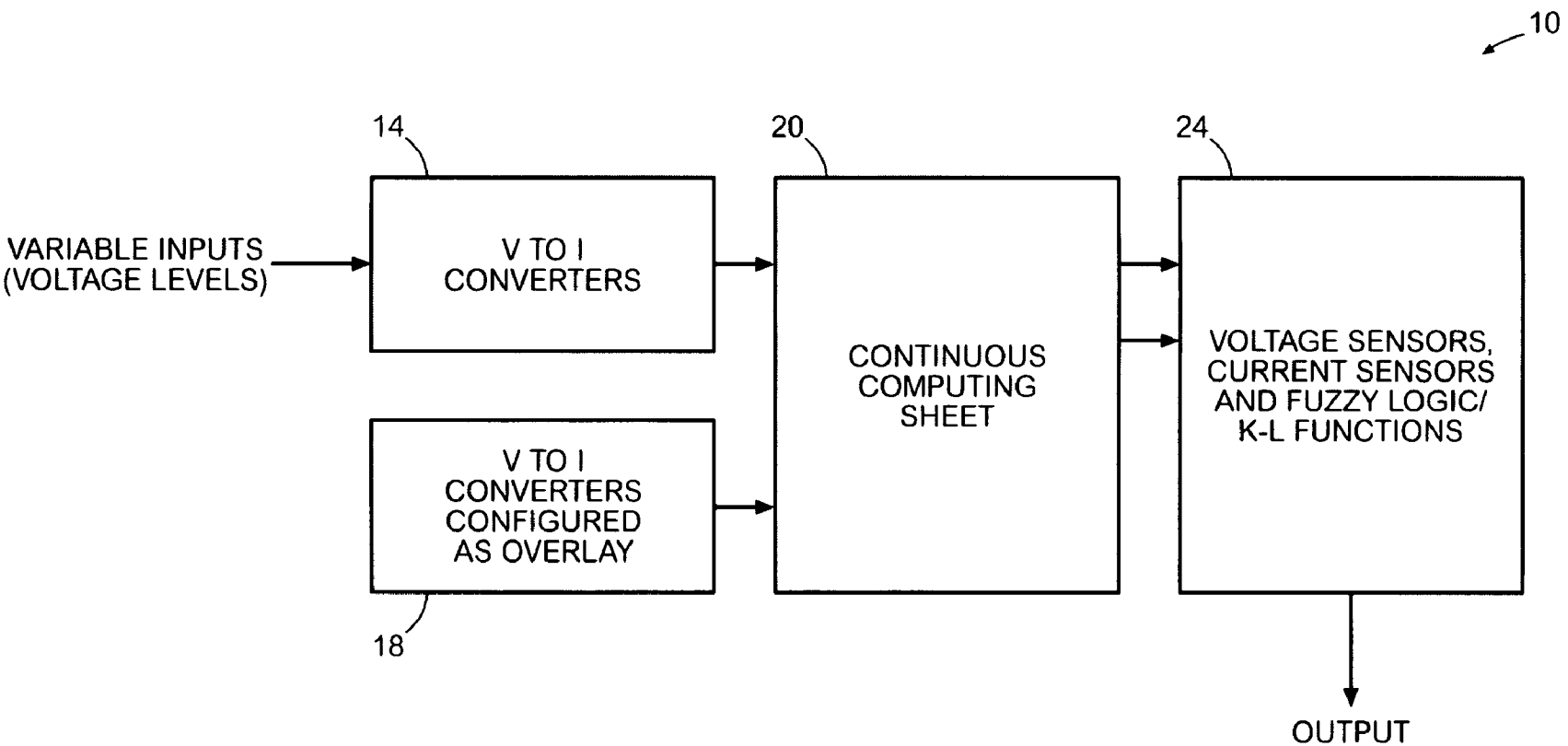
FIG. 1 is a block diagram of one embodiment of an extended analog computer configured for operating as an application controller.

An analog microcontroller may be described as an embodiment of an extended analog computer. An extended analog computer may be comprised of a plurality of electrical current injection and/or voltage application points on a continuous resistive sheet. A continuous resistive sheet may include sheet materials such as, but not limited to, silicon, conductive foam, and conductive polymers. Programming of the extended analog computer may be implemented with an overlay. An overlay may be described as a configuration of injected current sources and/or applied voltage sources, and fuzzy logic or Kirchhoff-Lukasiewicz (K-L) functions coupled to other processing elements.

A hybrid extended analog/digital computer (hEAC) is a combination of digital and analog circuitry. Factors such as device cost, device complexity, application flexibility, and system integration requirements are used to select an optimal configuration for implementing an application. The configuration may be adjusted for changing requirements.

For an analog microcontroller, an exemplary method or process for evolving an overlay utilizes an evolutionary algorithm, such as, but not limited to, particle swarm optimization. As noted above, an overlay is comprised of injected current sources and/or applied voltage sources, and fuzzy logic (FL) and/or Kirchhoff-Lukasiewicz function parameters. Moreover, the exemplary method simplifies the number and/or arrangement of the injected current sources and/or applied voltage sources, and/or the fuzzy logic or K-L functions as it adapts to corresponding parameters meeting certain criteria. The method also removes current sources, voltage sources, and/or functions from the overlay as it adapts to corresponding function parameters satisfying certain criteria.

The configuration or overlay generated by the method may be downloaded from a computer or a digital microcontroller in a manner that is analogous to the downloading of a file containing compiled computer code into a microcontroller. The method may be used to implement an artificial neural network on an analog computer. One aspect of the method is to configure a portion or all of the pins not reserved for inputs or outputs by evolving the current source (+) or sink (−) values and/or voltage sources that are coupled to the pins. For example, in one embodiment having a 25-pin R002 EAC board, input and output pins are selected and the functions and current sources/sinks for the remaining pins are evolved by the method. For example, each pattern in a 150-pattern Iris data set that represents three species of iris flowers may be generated from four variables (inputs). Therefore, four pins on one side of a continuous resistive sheet may be designated as inputs, and either 1 or 3 pins somewhere else on the sheet may be designated as outputs. The functions and/or current sources/sinks for other pins may be evolved. The evolution may also include revising the input/output pin designations. If three outputs are used in the example, the one generating the greatest current or voltage may be used to identify a class, although other ways of identifying a class may be used. If one output is used, fuzzy membership functions may be activated by the output. One example of the embodiment of an analog microcontroller appears in block diagram form in FIG. 1.

As shown in FIG. 1, an analog microcontroller 10 may include voltage-to-current converters 14, configured voltage-to-current converters 18, a computing sheet 20, and processing components 24. The voltage-to-current converters 14 are coupled to variable voltage sources that provide the inputs for the microcontroller 10. The voltage-to-current converters 18 are coupled to the computing sheet 20 in a manner determined by the method for configuring an overlay as discussed in more detail below. The computing sheet may be one of the resistive sheets described above, although other known forms of computing sheets may be used. The processing components 24 may include voltage sensors, current sensors, and fuzzy logic/K-L functions. These components are also coupled to the computing sheet in a manner determined by the method described below. The output of the controller 10 may be obtained from one of the processing components or from an output pin of the computing sheet.

The analog microcontroller 10 may have no digital components, although digital components may be used. The core computing performed by the microcontroller has been estimated to take less than a nanosecond. In analog implementations, the controller is often augmented with fuzzy logic membership functions or Lukasiewicz Logic Arrays. These functions/arrays are used in two primary ways, although other ways are possible. For one, output from an output pin may be passed through one of these functions/arrays. For another, output from an "intermediate" pin, that is, a pin which is neither an input nor an output, may be passed through one of these functions/arrays, and the result re-injected into another intermediate pin, or into an output pin. In addition to systems configured with one analog processor sheet, systems may include arrays of these sheets for significant extensions of the controller's computing capability. These sheets may be arranged in two dimensions, as a flat sheet of multiple processor sheets, or as a vertical column of multiple processor sheets. They may also be arranged in three-dimensional arrays, such as 10×10×10 (or larger) arrays. The various sheets may be located proximally to the controller, or may be geographically distributed in multiple locations and linked by communication links, such as the internet or other communication methodologies. Embodiments described below use evolutionary algorithms to implement a continuous distributed computational model that replaces a sequential digital computational model. This model is realized with structures that are evolved using evolutionary computation paradigms.

A process that may be used to develop an overlay for an extended analog computer (EAC) being used as a controller is now described. The process may be used to develop an overlay for an EAC incorporated into an analog/digital hybrid system, as well as for an EAC used as an analog microcontroller. The process is an example only as other processes may also be used. A controller in a control system is usually configured as operating on a number of input parameters. Different values of these inputs correspond to different output signals. Each time the controller is used, the controller receives a certain combination of inputs and provides, in response, an output, such as a control signal output in a PID-controller or a fuzzy controller.

To use an EAC as a controller, the input data pattern for each input parameter is characterized as an input current or input voltage for the EAC. Each input is provided within a range feasible for the EAC being used. Each parameter may be represented by current injected into one pin (or a voltage applied to one pin), although other representations are possible. The inputs may be passed to output pins via other pins on the EAC. Fuzzy logic or K-L functions may be coupled to input pin(s), intermediate pin(s,) and/or output pin(s).

The entire configuration, including the selection of the input pins, intermediate pins, and output pins, may be evolved. The example of the method now described, however, has the user select the pin configuration. The example process includes:

1) User selection of the input pins. Generally, one pin is used per input parameter, although other arrangements are possible. Each input current or voltage is set to be within the range of the current and/or voltage sources available for the resistive/conductive sheet used for the controller.
2) User selection of the intermediate and output pins. Each of these intermediate and output pins may have a fuzzy logic or K-L function coupled to it. The number of intermediate pins varies according to the control application. In some applications; no functions may be required.
3) To configure the system, a data pattern set is read. Each pattern includes a combination of inputs and the output expected for the input data.
4) Generate a configuration. Using an evolutionary algorithm, such as particle swarm optimization, configurations of current sources/sinks, voltage sources/sinks, and fuzzy logic or K-L functions or some combination thereof, that are coupled to the intermediate and output pins are evaluated to determine the one that produces the best performance. Best performance criteria may include minimizing some error metric, such as a percentage correct or sum-squared error, for the training pattern set used. The best configuration determination includes evolving values for currents, and/or voltages, or both, for intermediate and output pins. The determination may also include selecting one or more fuzzy logic or K-L functions for each of these pins.

5) Test the response of a configuration. Each pattern set may be read in multiple times. Each time an entire pattern set is read, one "generation" of the evolutionary algorithm is said to have occurred. The process is generally run until a sufficiently good configuration is obtained, or until the maximum number of generations specified by a user is reached.
6) Select a configuration. Because the evolutionary algorithm works with a population of potential solutions, more than one acceptable configuration may be evolved. The most desirable configuration may then be selected. In some cases, the configuration selected may not be the one with the lowest error. For example, if the error of one configuration is only very slightly higher, but the configuration consumes significantly less power, or is more robust in the presence of noise, it may be the configuration chosen.
7) Using the selected configuration, the controller is now ready for use. Inputs are applied, and the corresponding output for each set of inputs is obtained by processing the output currents/voltages on the output pins. The values of the output(s) were established during the above configuration process.

This process may be used to select a configuration for operating an EAC as a fuzzy controller. For example, an EAC may be used as an elevator brake fuzzy controller. The elevator brake control signal is determined by the speed of the elevator and the distance from the desired stop point. Consequently, two pins on the EAC were selected as inputs and a third pin was selected as the output. Four other pins were selected to be intermediate current sources. The above paradigm was used to train the EAC to implement a fuzzy control function by adjusting the intermediate current sources. The training process used nine patterns for the two inputs and one output. The two inputs were combinations of the low, medium, and high input values. The output was the fuzzy logic result of the input combination. They are listed in the following table:

| pattern | Speed | Distance | Break |
|---|---|---|---|
| 1 | Low | Near | Medium |
| 2 | Low | Medium | Low |
| 3 | Low | Far | Low |
| 4 | Medium | Near | High |
| 5 | Medium | Medium | Medium |
| 6 | Medium | Far | Low |
| 7 | High | Near | High |
| 8 | High | Medium | High |
| 9 | High | Far | Low |

The procedure to accomplish this task follows the procedure discussed above. The process includes:

1. During the start of the training process, a group of random intermediate current sources were generated. They were treated as the particles in a particle swarm algorithm.
2. Each pattern in the table was sent to the EAC and the output was read from the output pin. After all patterns were finished, the differences between the outputs read from the output pin with the desired outputs presented in the table were added as fitness values, which were assigned to the group of particles.
3. The particle swarm algorithm adjusted the particles, that is, the intermediate current sources, based on the particle swarm algorithm to reach better fitness values.
4. The input of pattern data and adjustment of the particles continued until one or more groups of intermediate current sources solved the desired outputs to conform to all the pattern data.

After the training was finished, a configuration was selected. The selected configuration included the locations of the input pins, output pins, intermediate current sources, and the values of the injected current sources. The EAC is then configured to solve the elevator brake fuzzy control application.

Implementing the above-described method/process enables the realization of an analog microcontroller for a particular application. As already noted, the device may be completely analog or incorporate digital elements. The analog microcontroller may be implemented with no RAM, no ROM, no clock, and no program as required with digital microcontrollers. Rather, an evolutionary algorithm, such as particle swarm optimization, is used to configure the analog microcontroller. The configuration may then be implemented with analog circuit elements and a resistive sheet being used as the processor.

A hybrid EAC (hEAC) is a device that contains a set of contact points arranged in a pattern on a conductive substrate. The contact points may be coupled to functions, such as current injection, current extraction, current measurement, and voltage application and/or measurement. The hEAC also includes a mixture of digital and analog circuitry to configure and operate on the currents/voltages at the contact points. The processing elements in the hEAC act to transform the currents/voltages using a transfer function that may include, but is not limited to fuzzy logic and Lukasiewicz logic functions. These functions may be implemented in either analog circuitry or synthesized using digital logic.

The split between analog and digital circuitry in the hEAC is a continuum. The system design point for the split between analog and digital circuitry may be designed manually or developed using an evolutionary technique for an optimal solution. Also, although the current embodiments of the hybrid configuration feature separate integrated circuits for the digital and analog processors, both of the functions may reside on one integrated circuit. In a manner analogous to math co-processors being integrated directly onto computer integrated circuits, the analog continuous sheet processor and its accompanying circuitry may be integrated onto the same integrated circuit containing the digital components.

The configuration of the hEAC mirrors the analog microcontroller in the use of evolutionary algorithms. In practice, an hEAC may be used by the evolutionary algorithm to develop the configuration that is instantiated into an analog microcontroller. Additionally, if the flexibility of an hEAC is required for an application, the hEAC may be developed into the device for the application. One example of the embodiment of an analog microcontroller implemented with a hEAC is depicted in block diagram form in FIG. 2. In that figure, the microcontroller 50 includes a communication interface 54, a microcontroller 58, input/output circuitry 60, current sources/sinks 64, current latches 68, voltage sensors 70, current sensors 74, and FL/LLA functions 78.

In greater detail, the communication interface 54 couples the microcontroller 58 to a personal computer 80, for example. The communication interface 54 may be implemented with a serial or USB link 84, a serial or USB to TTL converter 88, and/or a universal synchronous/asynchronous receiver/transmitter 90, as shown in the figure. One embodiment of the microcontroller 58 may be a MSP430 processor. The input/output circuitry 60 may include digital signal I/O circuitry 94, analog/digital converters 98, and digital/analog converters 100. The digital I/O circuit is coupled to the digital/analog converters 100, which generate analog signals that are used to operate the current sources/sinks 64. The current sources/sinks 64 are also coupled to pins in the conductive sheet processor 104 and to the FL/LLA functions 78. In this embodiment, the current sources/sinks 64 receive output signals from the FL/LLA functions 78. Other embodiments may be arranged differently, and may include features not shown in the depicted embodiment, such as voltage sources. The current sources and sinks coupled to the sheet processor 104 operate in accordance with these output signals as well as the signals received from the digital/analog converters 100. The digital I/O circuitry is also coupled to the current latches 68. These latches provide currents to the sheet processor and outputs from the sheet processor are coupled to the voltage sensors 70 and the current sensors 74. Some of the voltage signals and the current signals are provided from the voltage sensors and current sensors, respectively, to the analog/digital converters 98 for the conversion of these analog signals to digital values that are read by the controller. Some of the currents from the current sensors may be provided to the FL/LLA functions. As already noted some outputs of the FL/LLA functions are provided to the current sources/sinks. Other outputs may be provided to the analog/digital converters for conversion to digital values read by the controller. The computer 80 is not part of the hEAC, but couples the hEAC to other systems for various purposes.

Again with reference to FIG. 2, the continuous sheet process includes a matrix of pins, which may also be referred to as cells. Each cell may perform the function of sensing a voltage, sensing a current, or sourcing/sinking a current. For sensing a voltage, an analog multiplexer provides the voltage from a cell to one of the analog/digital converters coupled to the microcontroller. To sense a current, a transistor may be coupled between the cell and a relatively small value resistor, such as a 1K resistor. The base of the transistor is coupled to the microcontroller. In response to the microcontroller providing a voltage at the base, the current sensed in the cell is coupled to electrical ground through the collector/emitter of the transistor and the small valued resistor. The voltage across the resistor is measured to provide a value corresponding to the current sensed by the cell.

For current sourcing/sinking in this embodiment, a Howland topology current supply is coupled to a cell, although other types of current sources may also be used. The Howland type of current supply uses a single operational amplifier to provide positive and negative current to the cell by varying a control voltage. The input of the supply is biased so that voltages above about 1.6V sink current and voltages below about 1.6V source current. A digital-to-analog converter is serially connected to the operational amplifier so the microcontroller provides the control voltage that determines whether a cell sources or sinks current.

Figure 2:
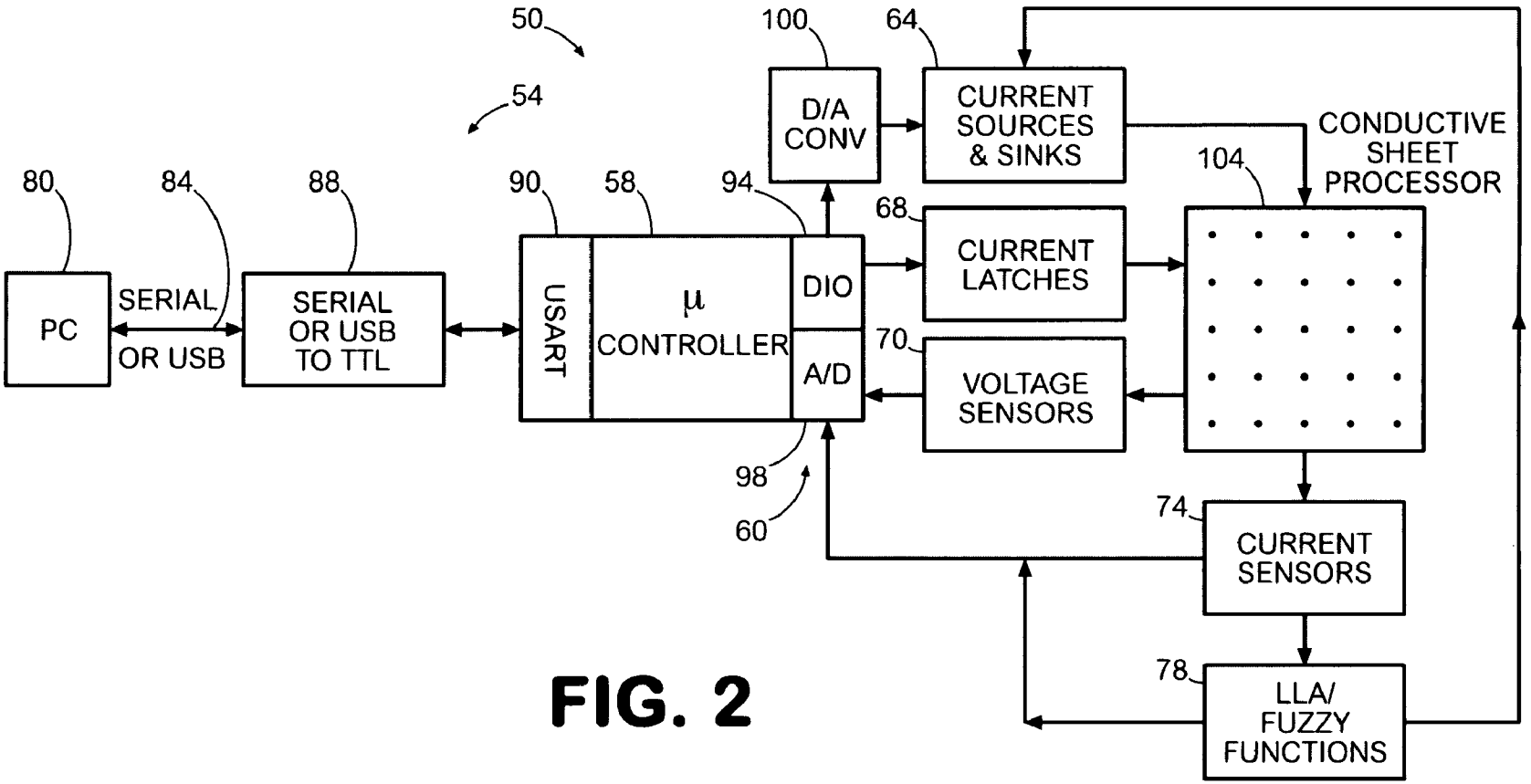
FIG. 2 is a block diagram of one embodiment of a hybrid extended analog computer configured for operating as an application controller.

The LLA/Fuzzy functions 78 shown in FIG. 2 are implemented by the microcontroller. For example, a pin may be configured as a current sense input. The current at the pin is digitized and provided to the microcontroller, which feeds it back to another pin. Thus, the program executed by the microcontroller include programmed instructions for implementing the various LLA/Fuzzy functions that are available for coupling to the cells of the continuous sheet processor.

The process described above may be used to develop an overlay for an extended analog computer (EAC) operating as a classifier. The process may be used for an EAC incorporated into a hybrid system, as well as for an EAC used as an analog microcontroller. The process is exemplary only as other processes may also be used.

A pattern classification problem is typically configured as operating on a number of input parameters with input configurations corresponding to classes. A classifier usually generates outputs to identify one class from a group of possible classes. The output of a classifier may, alternatively, classify an input configuration as being or not being a member of a class. In the classifier described below, the classifier receives a certain configuration of the inputs, and provides as output the classifier's estimate as to which class best represents the input configuration. A single "best fit" class may be indicated, or, the relative fit of more than one, perhaps, even all of the classes, may be indicated in some way, such as a rank ordering of the classes.

To use the EAC as a classifier, the input pattern data for each input parameter is characterized as an input current or input voltage for the EAC. Each input is within a feasible range for the EAC. Each parameter may be represented by current injected into one pin or voltage applied to one pin, although other arrangements may be used. The inputs may be passed to output pins via other pins on the EAC, and fuzzy logic or K-L functions may be used on the input pin(s), intermediate pin(s,) and/or output pin(s).

While the entire configuration, including the determination as to which pins are inputs, intermediate pins, or output pins, may be evolved, the following process has the user select the pin configuration. In this example, the process operates in the following manner:

1) User selection of input pins. Generally, one pin is used for each input parameter, although other mappings are possible. Each input current or voltage is set to be within the range of the current and/or voltage sources available for the resistive/conductive sheet being used for the processor.
2) User selection of intermediate and output pins. Each intermediate and output pin may have a fuzzy logic or K-L function coupled to it. The number of intermediate pins varies according to the classification application. In some applications; no intermediate pins may be required. One approach is to designate an output pin for each class to be identified by the classifier, but more than one class may be represented by a single pin. In the latter case, the output is appropriately processed to enable a single pin to represent multiple classes.
3) Read pattern data to configure the system. The pattern set includes the inputs and the class associated with each pattern.
4) Generate a configuration. Using an evolutionary algorithm, such as particle swarm optimization, establish a configuration of current sources/sinks, voltage sources/sinks, or some combination thereof, being coupled to the intermediate and output pins. The performance of a configuration may be measured using some error metric, such as percentage correct or sum-squared error for the training pattern set used. The values for the currents, voltages, or both, for the intermediate and output pins, may be evolved by selecting one or more fuzzy logic or K-L functions for each of these pins.

5) Test a configuration. Each pattern set may be read in multiple times. Each time the pattern set is read, one "generation" of the evolutionary algorithm has occurred. The algorithm is generally run until a sufficiently good configuration is obtained, or until the maximum number of generations specified by the user is reached.
6) Select a configuration. Because the evolutionary algorithm works with a population of potential solutions, more than one acceptable configuration may be evolved. The best configuration may then be selected. In some cases, the best configuration may not be the one with the smallest error measurement. For example, if the measured error difference between configurations is small, but one configuration consumes significantly less power or is more robust in the presence of noise, that configuration may be the selected configuration.
7) Using the selected configuration, the classifier is now ready for use. Inputs are applied, and the corresponding best class(es) for each set of inputs is obtained by processing the output currents/voltages on the output pins. The values of the output(s) corresponding to each class were established during the above configuration process.

The above process was implemented to solve the XOR problem. In this case, two pins on the EAC were selected as inputs and a third pin was selected as the output. Four other pins were selected to be intermediate current sources. The process described above was used to train the EAC to implement a XOR function by adjusting the intermediate current sources. The training process involves four patterns for the two inputs and one output. The two inputs were combinations of low and high inputs. The output was the XOR result of the input combination. They are listed in the following table:

| pattern | Input 1 | Input 2 | Output |
|---|---|---|---|
| 1 | Low | Low | Low |
| 2 | High | Low | Low |
| 3 | Low | High | Low |
| 4 | High | High | High |

The procedure to generate a configuration for this task may include:

1. Generating a ground of random intermediate current sources during the start of the training process. The intermediate current sources were treated as particles in the particle swarm algorithm.
2. Each pattern in the table was sent to the EAC and the output was read from the output pin. After all four patterns were read, the outputs read from the output pin were compared with the expected outputs presented in the table. Fitness values were assigned to the intermediate current sources according to the comparison results.
3. Using the particle swarm optimization algorithm, the intermediate current sources were adjusted to reach better fitness values.
4. The pattern data continued to be read and the intermediate current sources adjusted until one group of intermediate current source vales solved the XOR problem.

After the training was finished, a configuration was selected. The configuration identified the locations of the input, output, and intermediate pins, and the values for the injected current sources. In the given example, only seven pins were used to solve the problem since it was a relatively easy problem. For more complicated problems, more pins may be used and the particle swarm optimization may use all of the pins in the sheet processor to solve the problem.

Figure 3:
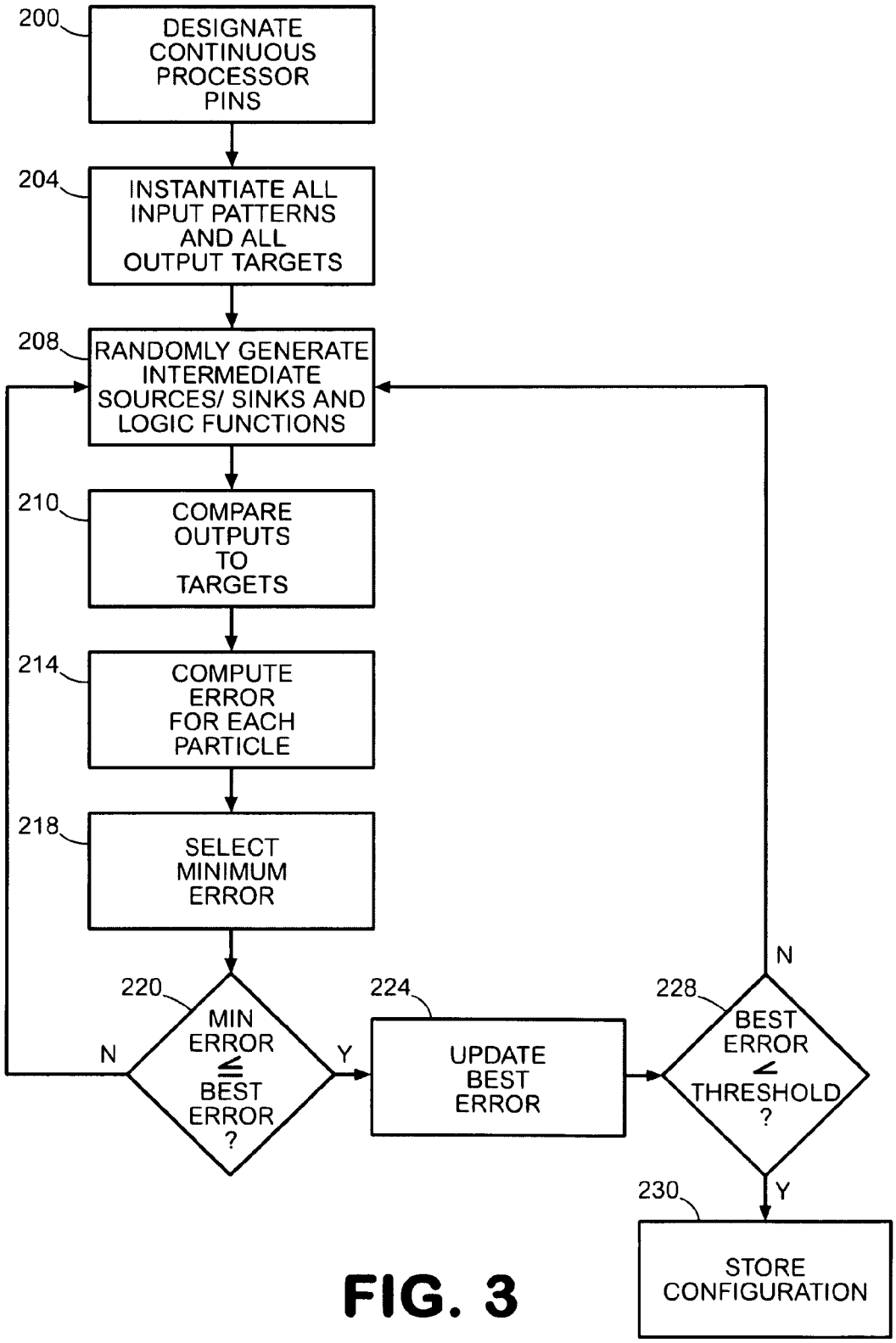
FIG. 3 is a flow diagram of one version of a continuous particle swarm optimization that may be implemented with an extended analog computer.

FIG. 3 depicts a continuous particle swarm optimization (PSO) process that may be implemented with an extended analog computer. Because all of the input patterns are instantiated once and the particles are evaluated in parallel, this process is significantly faster than a conventional iterative PSO. The process begins by designating the pins of a continuous processor (block 200.) For the two input XOR problem, eight pins would be designated as input pins and four pins would be designated as output pins. The remaining pins would be designated as intermediate pins. All of the input patterns and output targets are then instantiated (block 204.)

The continuous portion of the process begins with the random generation of intermediate sources/sinks and logic functions. The sources/sinks that may be coupled to intermediate pins may be current injection sources or sinks or applied voltages. The logic functions that may be coupled to intermediate pins include K-L functions and/or other fuzzy logic functions. The random selections of the sources/sinks and logic functions to be coupled to the intermediate pins may be performed with reference to a white noise generator. Following the coupling of sources/sinks and logic functions to the intermediate pins, the outputs are compared to the instantiated targets (block 210.) Preferably, this comparison is performed using analog comparators. An analog error is computed for each particle (block 214.) The errors are compared and the minimum error is selected (block 218.) Preferably, the comparison of the errors is performed with analog comparators. The minimum error is then compared to the best error for the particle to determine whether it is equal to or less than the best error obtained (block 220.) If the minimum error is greater than the best error obtained, an optimized configuration has not been obtained and the process continues by randomly generating another configuration (block 208.)

If the minimum error is as good as or less than the best error achieved by the process, the best error is updated (block 224) and the best error is compared to an optimization threshold (block 228.) If the best error is less than the threshold, the configuration for the intermediate pins is stored in memory (block 230.) Otherwise, the process continues to randomly generate configurations for the intermediate pins and evaluate the configuration to determine whether the configuration generates an error that is less than the optimal threshold. While the process has been described with reference to a threshold that may be used to terminate the process, the process, alternatively, may store an optimal configuration, and then continue the process to determine whether other optimal configurations exist. The best error associated with a configuration may be used to determine whether an optimized configuration solution has been developed and then stored as an alternative configuration, before continuing the process.

Those skilled in the art will recognize that numerous modifications can be made to the specific implementations described above. While the embodiments above have been described with reference to specific applications, embodiments addressing other applications may be developed without departing from the principles of the invention described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method for configuring an extended analog microcontroller for a control application comprising:

selecting input pins from among a plurality of pins in a continuous sheet processor;

selecting an arrangement of intermediate and output pins from among the remaining pins in the plurality of pins in the continuous sheet processor;

applying a pattern data set to the input pins;

using an evolutionary algorithm, couple current sources and sinks to the intermediate and output pins;

measuring an error between an output and its expected value; and continuing to select intermediate and output pin arrangements, apply pattern data sets, and measure errors until a configuration threshold is met.

2. The method of claim 1, the coupling of current sinks and sources to the intermediate and output pins is implemented using a particle swarm optimization process.

3. The method of claim 1, the measured error is one of percentage error and a sum squared error.

4. The method of claim 1 further comprising:

coupling fuzzy logic and Lukasiewicz logic functions to the intermediate and output pins with the use of the evolutionary algorithm.

5. The method of claim 1, the coupling of the current sources and sinks further comprising:

generating a group of intermediate current source locations and values; and treating the group of intermediate current source locations and values as a group of particles for a particle swarm algorithm.

6. The method of claim 5, the application of the pattern data set further comprising:

applying a pattern data set from a plurality of elevator brake fuzzy logic controller training pattern data sets;

reading a response from an output pin; and measuring a difference between the response and an expected response for the training pattern data set applied to the intermediate pins.

7. The method of claim 6 further comprising:

applying the remaining pattern data sets in the plurality of elevator brake fuzzy logic controller training pattern data sets;

reading a response from the output pin for each application of a pattern data set;

measuring a difference between each response and its expected response; and adding the differences to generate a fitness value for the group of intermediate current source locations and values to which the plurality of elevator brake fuzzy logic controller training pattern data sets were applied.

8. The method of claim 7 further comprising:

adjusting the group of intermediate current source locations and values in accordance with a particle swarm formula; and reapplying the plurality of elevator brake fuzzy logic controller training pattern data sets, reading the responses, measuring the differences, and generating a fitness value for the adjusted group of intermediate current source locations and values.

9. The method of claim 8 further comprising:

comparing a fitness value for a group of intermediate current source locations and values to the fitness values for the other groups of intermediate current source locations and values that were generated; and selecting the group of intermediate current source locations and values having a best fitness value determined from the comparisons of fitness values.

10. A method for configuring an extended analog microcontroller for a classifier application comprising:

selecting input pins from among a plurality of pins in a continuous sheet processor;

selecting an arrangement of intermediate and output pins from among the remaining pins in the plurality of pins in the continuous sheet processor;

applying a pattern data set having pattern data inputs and a corresponding class for the pattern data inputs to the input pins;

using an evolutionary algorithm, couple current sources and sinks to the intermediate and output pins;

measuring an error between an output and its expected class; and continuing to select intermediate and output pin arrangements, apply pattern data sets, and measure errors until a configuration threshold is met.

11. The method of claim 10, the coupling of current sinks and sources to the intermediate and output pins is implemented using a particle swarm optimization process.

12. The method of claim 10, the measured error is a percentage error or a sum squared error.

13. The method of claim 10 further comprising:

coupling fuzzy logic and Lukasiewicz logic functions to the intermediate and output pins with the use of the evolutionary algorithm.

14. The method of claim 10, the coupling of the current sources and sinks further comprising:

generating a group of intermediate current source locations and values; and treating the group of intermediate current source locations and values as a group of particles for a particle swarm algorithm.

15. The method of claim 14, the application of the pattern data set further comprising:

applying a pattern data set from a plurality of classifier training pattern data sets;

reading a classification response from an output pin; and measuring a difference between the classification response and an expected classification response for the training pattern data set applied to the intermediate pins.

16. The method of claim 15 further comprising:

applying the remaining pattern data sets in the plurality of classifier training pattern data sets;

reading a classification response from the output pin for each application of a pattern data set;

measuring a difference between each classification response and its expected classification response; and adding the differences to generate a fitness value for the group of intermediate current source locations and values to which the plurality of classifier training pattern data sets were applied.

17. The method of claim 16 further comprising:

adjusting the group of intermediate current source locations and values in accordance with a particle swarm formula; and reapplying the plurality of classifier training pattern data sets, reading the responses, measuring the differences, and generating a fitness value for the adjusted group of intermediate current source locations and values.

18. The method of claim 17 further comprising:

comparing a fitness value for a group of intermediate current source locations and values to the fitness values for the other groups of intermediate current source locations and values that were generated; and selecting the group of intermediate current source locations and values having a best fitness value determined from the comparisons of fitness values.

* * * * *